US005865651A

United States Patent [19]

Dague et al.

[11] Patent Number: 5,865,651

[45] Date of Patent: Feb. 2, 1999

[54] FEMALE CONNECTOR FOR MATING WITH 3-IN-1 IDE INTERFACE AND POWER CONNECTOR WITH RECESSES AND PROJECTIONS FOR FACILITATING ENGAGEMENT

[75] Inventors: Wallis Allen Dague, Louisville, Colo.; Virat Thantrakul, La Crescenta, Calif.

[73] Assignee: Seagate Technology, Inc., Scotts Valley, Calif.

[21] Appl. No.: 767,774

[22] Filed: Dec. 17, 1996

[51] Int. Cl.[6] ..... H01R 13/64

[52] U.S. Cl. ..... 439/680; 439/218

[58] Field of Search ..... 439/79, 80, 378, 439/680, 681, 218

[56] References Cited

U.S. PATENT DOCUMENTS

| | | | |
|---|---|---|---|
| 3,966,290 | 6/1976 | Little et al. | 439/680 |
| 4,376,565 | 3/1983 | Bird et al. | 439/681 |
| 4,582,386 | 4/1986 | Martens | 439/62 |
| 4,900,261 | 2/1990 | Gentry et al. | 439/680 |
| 4,986,769 | 1/1991 | Adams, III et al. | 439/681 |
| 5,080,604 | 1/1992 | Rider et al. | 439/680 |
| 5,443,398 | 8/1995 | Ortega | 439/378 |

*Primary Examiner*—Neil Abrams
*Attorney, Agent, or Firm*—McDermott, Will & Emery

[57] ABSTRACT

A female connector system for engaging, a matching male 3-in-1 IDE connector has, in certain embodiments, three alternatively usable, different length female connectors formed for mating with all or selected portions of the male connector. These include a set of data pin-receptacles, a set of jumper pin-receptacles, and a set of power pin-receptacles. To provide swift and secure engagement of the female connector to a 3-in-1 male connector, the female connector has a number of surface features. These include two locating projections that aid in properly locating the female connector with respect to the 3-in-1 male connector. A fitting portion and a groove are provided in one of the planar surfaces of the female connector and further aid in proper location and mating. An inclined surface at the corner of the female connector acts in cooperation with angled surfaces of the groove to facilitate simultaneous engagement of numerous pins of the male connector with correspondingly disposed pin-receptacles of the female connector.

23 Claims, 4 Drawing Sheets

FIG. 1
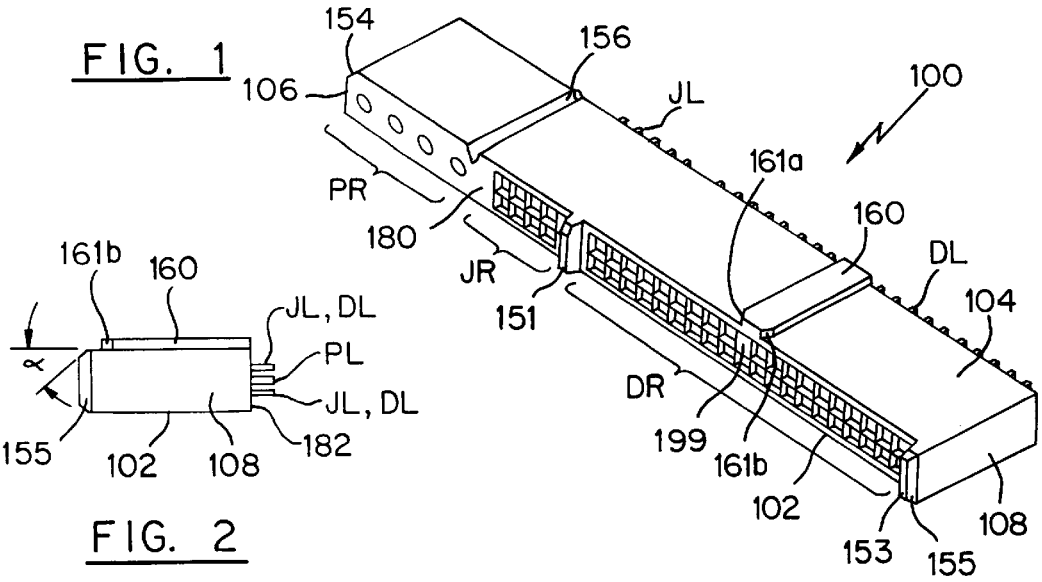
FIG. 2
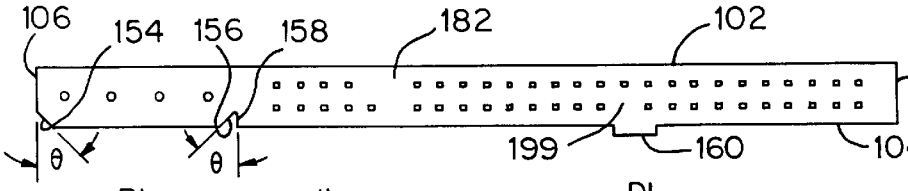
FIG. 3
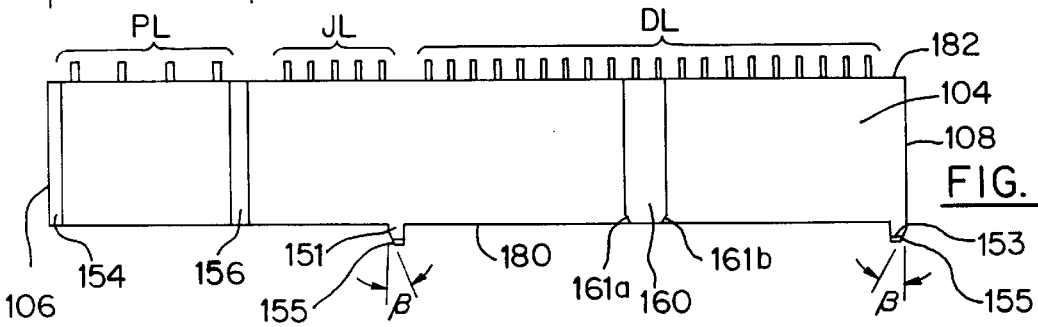
FIG. 4
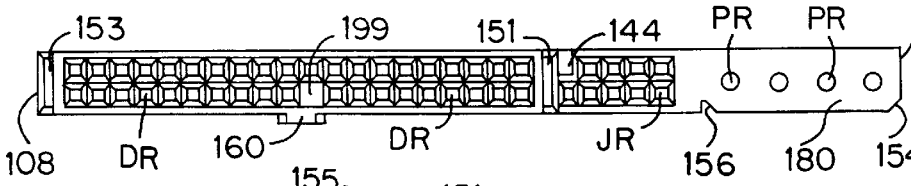
FIG. 5
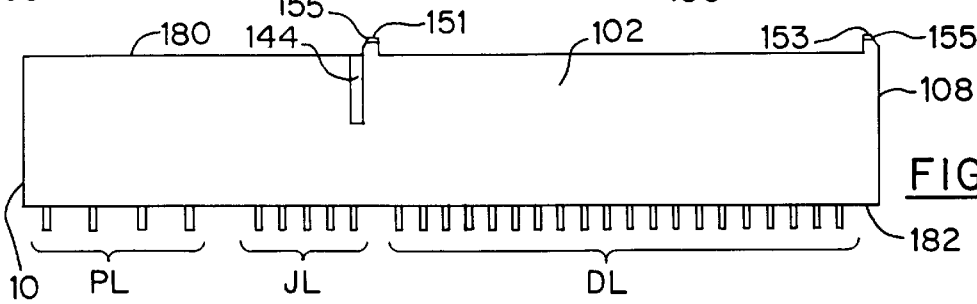
FIG. 6

FIG. 7
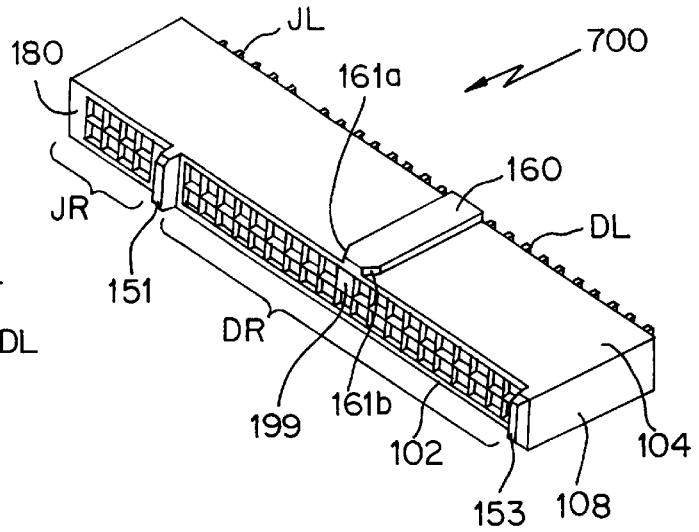
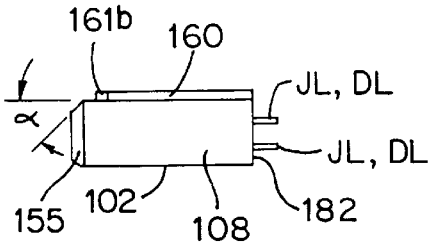
FIG. 8
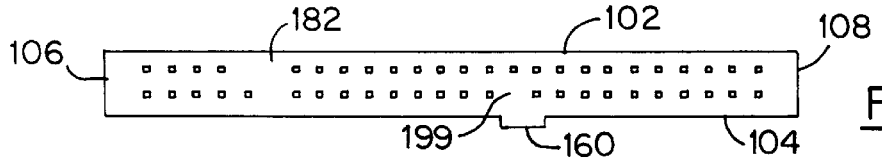
FIG. 9
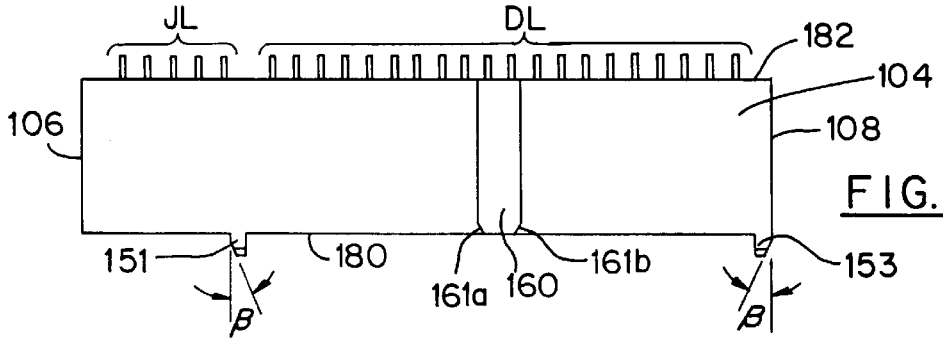
FIG. 10
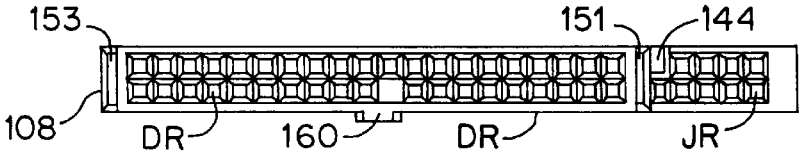
FIG. 11
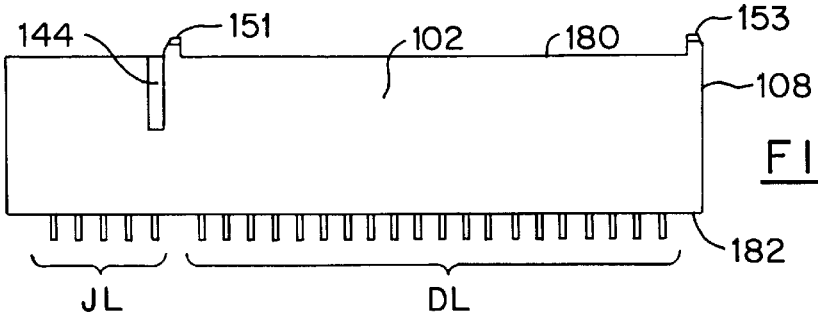
FIG. 12

FIG. 13
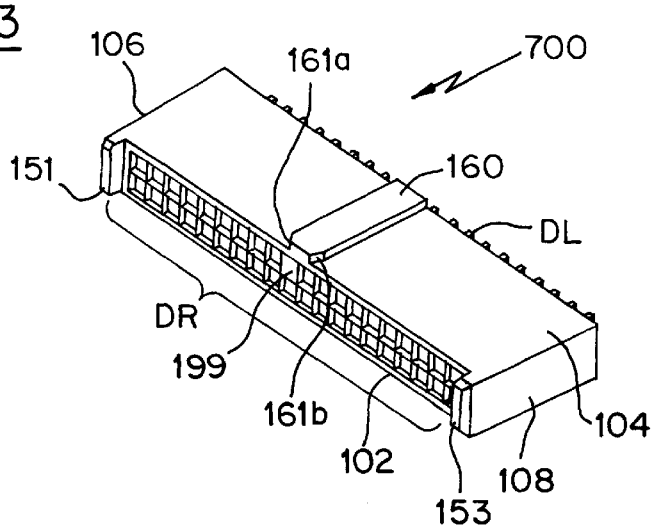
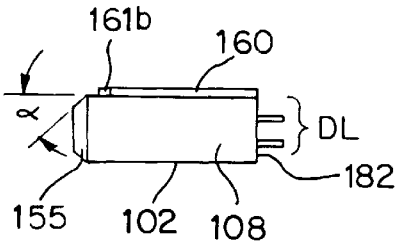
FIG. 14
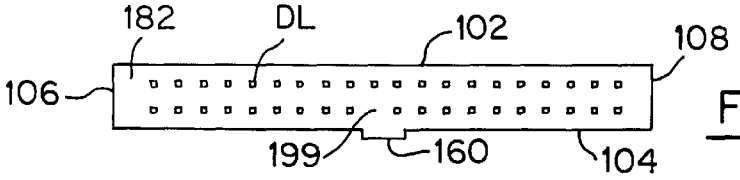
FIG. 15
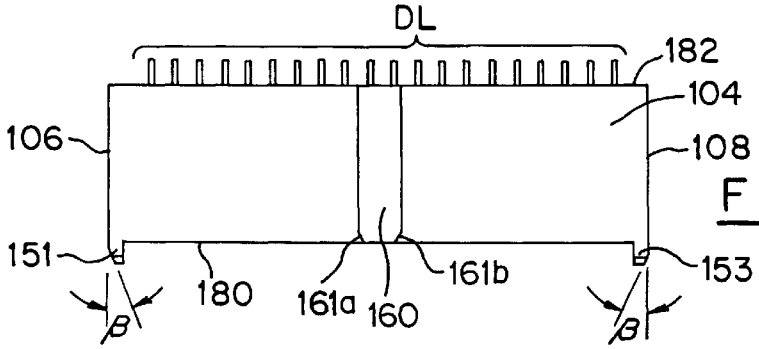
FIG. 16
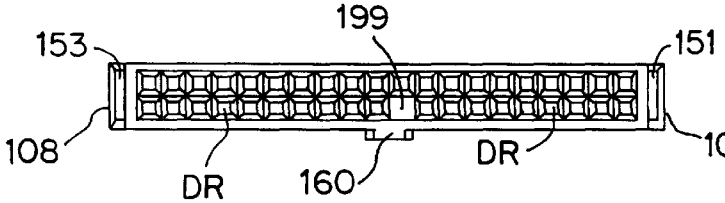
FIG. 17
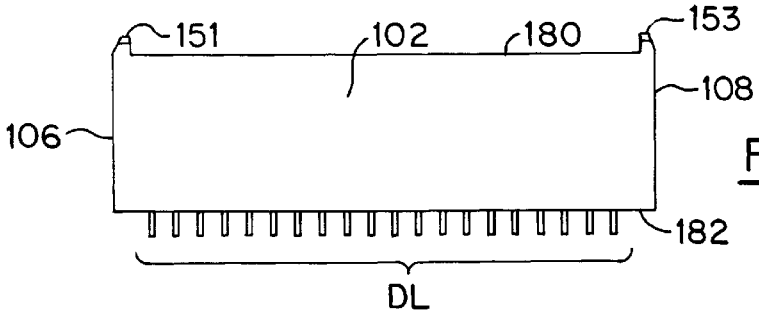
FIG. 18

FEMALE CONNECTOR FOR MATING WITH 3-IN-1 IDE INTERFACE AND POWER CONNECTOR WITH RECESSES AND PROJECTIONS FOR FACILITATING ENGAGEMENT

FIELD OF THE INVENTION

This invention relates to female electrical connectors of a type engageable with matching integrated drive electronics (IDE) interface and power male connectors, and more particularly to female connectors usable with an IDE interface and power connector which permits selective engagement of 12.0 and 5.0 volt power supplies with full backward compatibility, i.e., which permits a user of existing systems to continue using a 5.0 volt supply while simultaneously permitting engagement with a 3.3 volt supply by test jumpers, and/or with data lines.

BACKGROUND OF THE RELATED ART

Hard disk drives for computers and the like employ application specific integrated circuits (ASICs). Such disk drives typically employ disk drive motors which generally use a 12.0 V electric power supply. FIGS. 19 and 20 show, in perspective and front elevation views respectively, certain principal features of such a conventional interface and power connector of a type that is typically fitted to a user-accessible part of a circuit board. Such circuit boards support various elements of circuits, including ASICs.

Most ASICs currently in use employ 5.0 V supplies, but it is apparent that there are significant advantages, e.g., reduced power, better performance, etc. that can be realized by employing power at 3.3 V instead. Since many existing 5.0 V systems are currently in active use, and are likely to be used at least for the foreseeable future, there is currently a need for a versatile and easily usable interface and power connector system which will enable a user to selectively connect a circuit to either a 5.0 V or 3.3 V supply, depending on whether it is the older or newer type respectively, as well as to a 12.0 V supply.

Furthermore, there are also circumstances where it would be beneficial to selectively connect a jumper for specific or limited testing of portions of the circuit without disengaging existing power and data-transmission connections. There is, therefore, another present need for a connector system which will facilitate such temporary engagement with a female test jumper to an existing circuit via a male connector already connected to power supplies for the circuit.

A need also exists, for certain applications, for permanent connections of the male connector already connected to the circuit to one or more jumpers (female connectors), e.g., for drive mode selection. Such a use would require engagement pins of the male component with matchingly disposed receptive elements in a corresponding female jumper component in larger numbers than are typically available in existing connector systems.

It is important that the female connector elements be formed to be relatively easily yet securely connectable to the corresponding male components without the need for excessive care being exercised by a user. In practice, this requires that a balance be struck between the ever pressing need for compactness of the components as against the need to ensure structural integrity of the engaging components in repeated engagements/disengagements during anticipated use.

The present invention is intended to fulfill these needs by providing versatile female connectors conveniently engageable with both existing and improved male connector components, particularly to permit data exchange, the conveyance of electrical power, and the engagement of test jumpers and the like in systems which include integrated drive electronics interfaces.

SUMMARY OF THE INVENTION

A principal object of this invention is to provide female connectors selectively connectable to a male integrated drive electronics interface and power connector to provide 5.0 V and/or 3.3 V power supply to an ASIC.

A related object of this invention is to provide female connector elements in an interface and power connector system, for connecting transmission lines, power supplies, test jumpers and the like to ASICs and ancillary elements of a hard disk drive system receiving any one or combination of 12.0 V, 5.0 V and 3.3 V power supplies.

A further object of this invention is to provide female connectors selectively engageable with a 3-in-1 type 12.0 V, 5.0 V and 3.3 V interface and power connector (a male connector) to form connections which permit independent and selective use of any of these three power supplies while also enabling the connection of a test jumper without disturbing power supplies already connected to integrated drive electronics.

These and other related objects are realized by providing, in a first preferred embodiment of this invention, a female connector for mating with a selected portion of an elongate male 3-in-1 IDE interface and power connector, to selectively engage therewith to connect to data transfer lines via a set of data transfer pins of the male connector. This female connector has an elongate generally cubical body of a length, a width, and height to match the selected portion of the male connector. The body has a front face, a rear face and a peripheral surface comprising a planar upper part, a discontinuously planar base part, and first and second end parts. A fitting portion projects outwardly of the base part and is oriented in a width-wise direction of the body. First and second locating projections extend outwardly of the front face. A set of open-ended pin-receptacles is mounted in and extends through the body in a width-wise direction. Each pin-receptacle is arrayed to receive, through the front face of the body, a respective data transfer pin of the male connector.

According to a second preferred embodiment there is provided a female connector for mating with a selected portion of an elongate male 3-in-1 IDE interface and power connector, to selectively engage therewith to provide electrical power at a selected voltage and connect to data transfer lines via respective first and second sets of pins of the male connector. This female connector has an elongate generally cubical body of a length, a width, and height to match the selected portion of the male connector. The body has a front face, a rear face and a peripheral surface comprising a planar upper part, a discontinuously planar base part, and first and second end parts. A fitting portion projects outwardly of the base part and is oriented in a width-wise direction of the body. First and second locating projections extend outwardly of the front face. First and second sets of open-ended pin-receptacles are mounted in and extend through the body in a width-wise direction thereof. Each set of pin-receptacles is arrayed to receive through the front face of the body a respective set of correspondingly arrayed pins of the male connector. The first set includes pin-receptacles for providing electrical power at the selected voltage, and the second set includes pin-receptacles for connecting to respective data transfer lines. Each pin-receptacle has a lead end projecting from the rear face of the body.

According to a third preferred embodiment there is provided a female connector for mating with an entire male 3-in-1 IDE interface and power connector, to engage therewith to provide electrical power selectively at first, second and third voltages and to connect to data transfer lines via respective first, second and third sets of pins of the male connector. This connector has an elongate generally cubical body of a length, a width, and height to match the full engaging male connector. The body has a front face, a rear face and a peripheral surface which includes a planar upper part, a discontinuously planar base part, first and second end parts, and a first angled face which intersects the second end part and the base part and is inclined at a first angle to the base part. A groove is provided in the base part, and has a cross-section partially defined by a second angled surface inclined at a second angle to the base part. A fitting portion projects outwardly of the base part and is oriented in a width-wise direction of the body. First and second locating projections extend outwardly of the front face. First, second and third sets of open-ended pin-receptacles are mounted in and extend through the body in a width-wise direction thereof. Each set of pin-receptacles is arrayed to receive through the front face of the body a respective set of correspondingly arrayed pins of the male connector. The first set includes pin-receptacles for providing electrical power at the selected first and second voltages, the second set includes pin-receptacles for providing power at the selected third voltage, and the third set includes pins for connecting to respective data transfer lines. Each pin-receptacle has a lead end projecting from the rear face of the body.

BRIEF DESCRIPTION OF THE DRAWING

FIG. 1 is a frontal perspective view of a female connector, formed according to the first preferred embodiment, to engage with a portion of a male connector to engage data transmission lines of an IDE interface of a type exemplified in co-pending U.S. utility application Ser. No. 08/714,478, titled "3-IN-1 IDE INTERFACE AND POWER CONNECTOR", filed on Sep. 16, 1996, and U.S. design application Ser. No. 29/059,797, titled "3-IN-1 IDE INTERFACE AND POWER CONNECTOR", filed on Sep. 16, 1996, both to the present Applicants.

FIG. 2 is an end elevation view of the first embodiment per FIG. 1, the opposite end view being a mirror image thereof.

FIG. 3 is an end elevation view of the first embodiment.

FIG. 4 is a top plan view of the first embodiment.

FIG. 5 is a front elevation view of the first embodiment.

FIG. 6 is a bottom plan view of the first embodiment.

FIG. 7 is a frontal perspective view of a second preferred embodiment which includes a first portion to enable engagement with a plurality of data lines and an adjacent second portion integral with the first portion to enable jumper/power supply connection.

FIG. 8 is an end elevation view of the second embodiment per FIG. 7, the opposite end view being a mirror reflection thereof.

FIG. 9 is a rear elevation view of the second embodiment.

FIG. 10 is a top plan view of the second embodiment.

FIG. 11 is a front elevation view of the second embodiment.

FIG. 12 is a bottom plan view of the second embodiment.

FIG. 13 is a frontal perspective view of a third preferred embodiment of this invention, which includes a first portion to facilitate engagement with a first plurality of data lines, a second portion to facilitate engagement with a plurality of power supply or jumper lines, and a third portion for engagement with a 12.0 V power supply, all being integrated into a single unit.

FIG. 14 is an end elevation view of the third embodiment per FIG. 13, the opposite end view being a mirror image thereof.

FIG. 15 is a rear elevation view of the third embodiment.

FIG. 16 is a top plan view of the third embodiment.

FIG. 17 is a front elevation view of the third embodiment.

FIG. 18 is a bottom plan view of the third embodiment.

DETAILED DESCRIPTION OF THE PREFERRED EMBODIMENTS

It may be helpful to consider initially the forms and certain features of the type of IDE interface and power male connectors with which the female connectors of the present invention are to be engaged during use.

Figure 19:
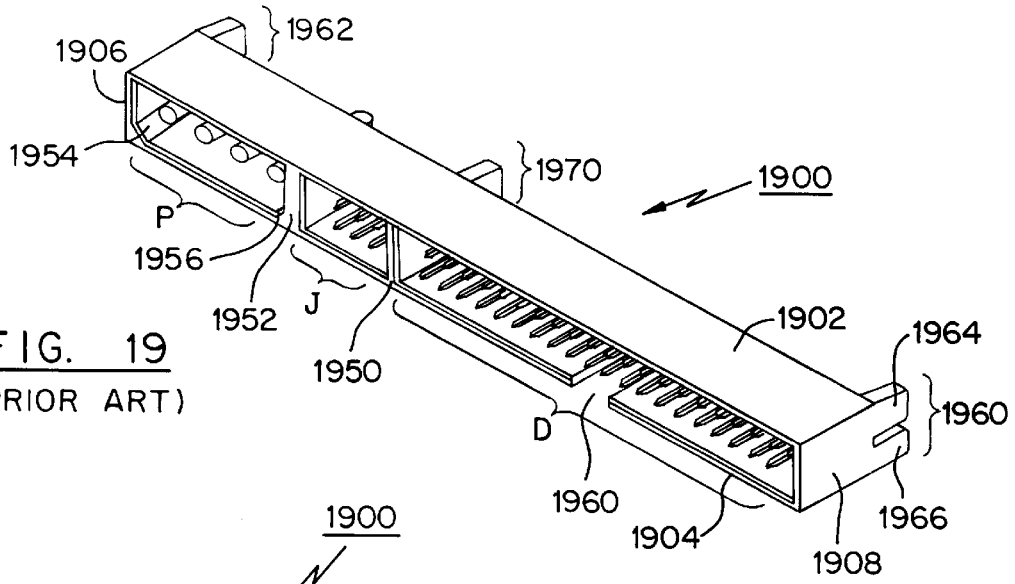
FIG. 19 (PRIOR ART)
FIG. 19 is a frontal elevation view of a known male 3-in-1 IDE interface and power connector.
Figure 20:
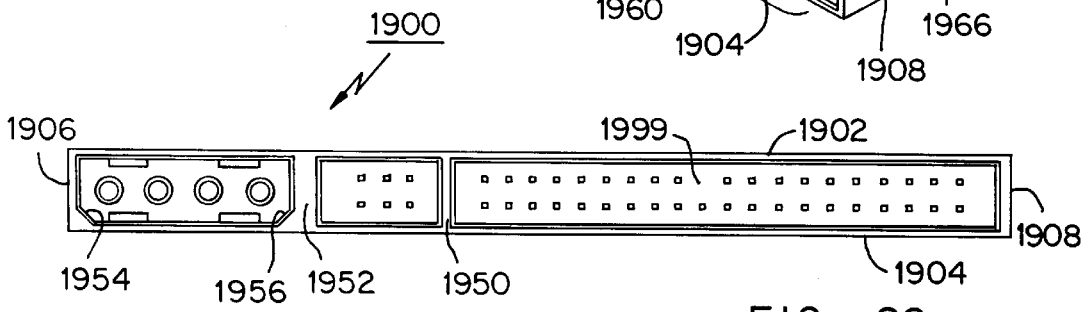
FIG. 20 (PRIOR ART)
FIG. 20 is a front elevation view of the known male connector per FIG. 19.

FIGS. 19 and 20 are perspective and front elevation view, respectively, of a known IDE male connector. Such a male connector 1900 has a generally cubical elongate body made of an electrically insulating plastics material defined by a peripheral surface including a plane upper part 1902, a plane bottom part 1904 and end parts 1906 and 1908, and a transverse wall which supports three sets of pins having distal ends disposed within separate compartments. There are two internal partitions 1950, 1952, each oriented in a height-wise direction, which together define three laterally separated compartments each housing one of the three sets of engageable forwardly- extended pins. From the right-hand side, as best seen in the front elevation view of FIG. 20, there is a first set of pins "D" for data transfer, each of these pins being linked at the rear end to a corresponding data line (not shown for simplicity). The compartment next to the set of data pins "D" contains a second set of pins "J" connectable to a power supply at a first selected voltage, e.g., 3.3 V or, optionally, to test jumpers or the like. This set of pins "J" is generally smaller in number and is usually not connected to data lines. The set of data pins "D" is separated from the set of jumper pins "J" by partition 1950. A third set of pins "P" for providing power, typically at 12.0 V or 5.0 V, is provided in the third compartment, defined by a height-wise partition 1952 separating the power pins "P" from the jumper pins "J". In the compartment housing the power pins "P", there may be provided two angled faces 1954 and 1956 which serve to guide in a correspondingly shaped female connector for forcible engagement with power pins "P".

In addition, in this known male connector element 1900 there is typically found a cut-out 1960 in the base wall, shaped and sized to receive therein a correspondingly shaped and located extension of a female data line connector (not shown). Furthermore, at both ends of the male connector body, extending rearwardly from a rear thereof, are first and second gripper extensions 1960 and 1962, each of which typically is slitted to provide a narrow opening forcibly engageable with an edge portion of a typical electronics circuit board. Thus, for example, the gripper extension 1962 may typically be split into two portions 1964 and 1966 separated by a gap suitable for firmly gripping an edge of a circuit board. An additional gripper extension 1970 may be provided intermediate the gripper extensions 1960 and 1962 adjacent the ends of the male connector.

In known male connector 1900 there are typically two parallel lines of data pins "D", which may but need not contain equal numbers of the pins. An exemplary pinless space is left at 1999 in the upper line above cut-out 1960 to indicate this. Six jumper pins "J" are typically provided, also in two lines, each containing only three pins. Four power pins "P" are provided, and are typically used in pairs for 12.0 V and 5.0 V supplies.

The above-described known male connector, although in use, has numerous limitations, and these are addressed by a 3-in-1 IDE male connector disclosed and claimed in co-pending U.S. Utility application Ser. No. 08/714,478 and co-pending U.S. Design application Ser. No. 29/059,797. Relevant structural details of the 3-in-1 IDE male connector disclosed therein are incorporated herein by reference. This male connector structure differs from the known structure per FIGS. 19 and 20 in many ways. For convenience of reference, elements and structural features comparable to those previously described herein will be identified by numerals having the same last two digits. Thus, for example, what was identified as upper part 1902 of the peripheral surface of the male connector 1900 in FIGS. 19 and 20 is identified as upper part 2102 in FIGS. 21 and 22, etc.

In the improved male connector 2100, the partition 1950 of connector 1900 has been replaced by a downwardly depending internal flange 2144 which stiffens the upper part 2102 but does not extend all the way to lower part 2104. Flange 2144 leaves room for the inclusion of an additional pin of set "J" in the bottom line. This makes it possible to optionally have as many as nine jumper pins (4 in an upper line and 5 in the lower line). Note that in FIG. 21 only eight jumper pins (4 in each line), are shown, whereas in FIG. 22 an optional ninth pin 2109 (located in the lower line beneath external flange 2144) is shown to indicate the added pin capacity provided by the modified structure of the male connector body. The male connector 2100 also differs from the prior art connector 1900 in providing notches 2136 and 2138, respectively above and below jumper pins "J", to facilitate convenient engagement thereat of a corresponding female jumper or suitable test line. In addition, partition 1952 of connector 1900 between jumper pins "J" and power pins "P" is replaced by a locator element 2128 having a generally triangular cross-section defined in part by angled surface 2156. Yet another distinction between these structures is the provision of recesses 2151 and 2153 immediately inboard of internal flange 2144 and end part 2108 in male connector 2100.

The preceding discussion is considered helpful in understanding various structural features of the claimed invention because the male 3-in-1 IDE connector 2100 is to be operatively engaged, in part or entirely, by each of the three embodiments of the female connector described hereinbelow with reference to FIGS. 1–18 and as specifically claimed herein.

Figure 21:
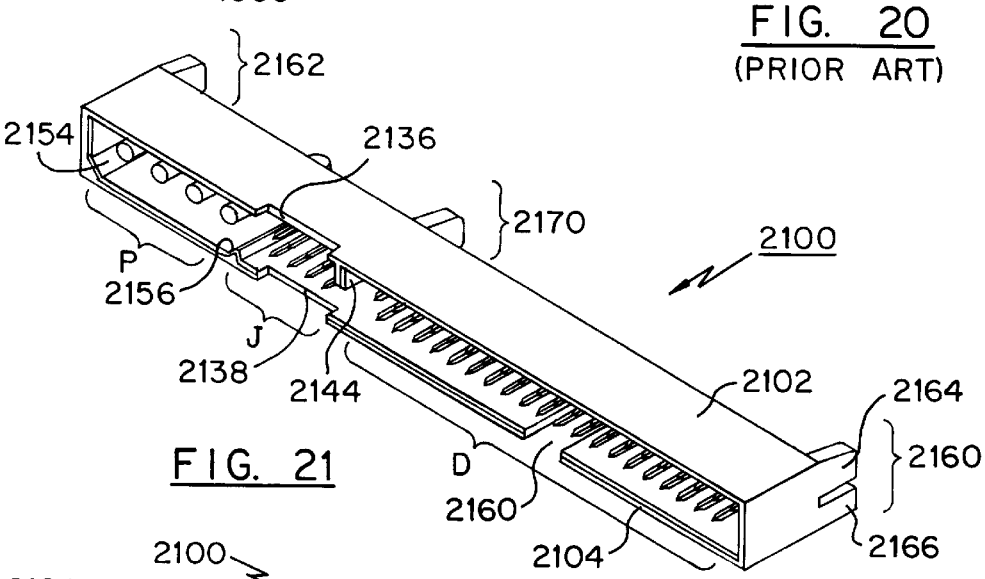
FIG. 21 is a frontal perspective view of an improved 3-in-1 IDE interface and power male connector per co-pending U.S. utility application Ser. No. 08/714,478 and U.S. design application Ser. No. 29/059,797, supra, both filed on Sep. 16, 1996.
Figure 22:
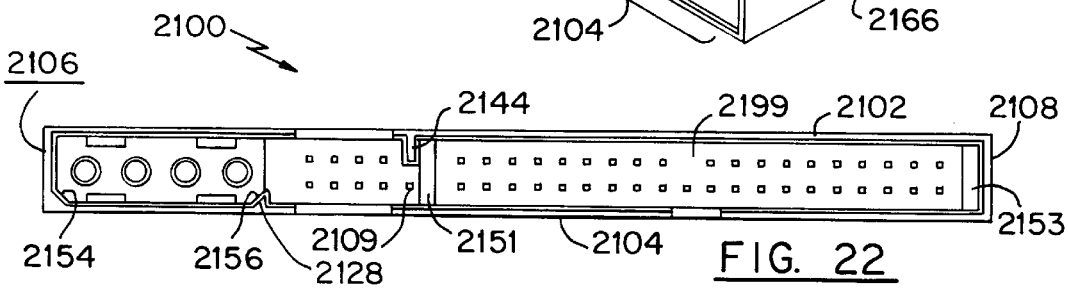
FIG. 22 is a front elevation view of the improved 3-in-1 male connector per FIG. 21.

In the first preferred embodiment per FIGS. 1–6, female connector 100 has a generally cubical body intended for simultaneous engagement with all three sets of data pins "D", jumper pins "J" and power pins "P" of a 3-in-1 male connector 2100 as shown in FIGS. 21 and 22 hereof and as described above. This female connector 100 has a peripheral outer surface comprising an upper part 102 (which in use will fit closest to upper part 2102 of male connector 2100), a base part 104 (which in use will fit closest to base part 2104 of male connector 2100, etc.), and end parts 106 and 108. Upper part 102 is continuously planar, whereas base part 104 is discontinuously planar and includes a fitting projection 160 extending outwardly of planar base part 104 and oriented in a width-wise direction of the female connector body 100. Note that in accordance with the numbering system employed here, to facilitate use of female connector 100 the outwardly projecting fitting portion 160 is sized and shaped to be closely received into cutout 2160 when female connector 100 is operatively fitted to all of data pins "D", "J", and "P" of a male connector 2100.

The front part of fitting portion 160 is tapered by the provision of facets 161*a* and 161*b*, as best seen in FIGS. 1 and 4, to facilitate fitting thereof into cutout 2160. Such structural shaping of elements which must interfit with each other is important because many of the pins of male connector 2100 are relatively close together, may be somewhat fragile, and because any deformation of even one pin may seriously interfere with the utility of the invention. This aspect of the invention, namely the tapering of a forward portion of an element which is to be received into a cutout or opening of another portion is practiced elsewhere in the overall structure. This will be referred to as appropriate in the following description.

In addition, preferably two locating projections, 151 and 153, are formed to extend forwardly of front face 180 of female connector 100. Of these, locating projection 153 is preferably provided at and contiguous with end part 108 of the peripheral surface, and locating projection 151 is preferably located between end parts 106 and 108.

In the first embodiment per FIGS. 1–6, lower part 104 and end part 106 of the peripheral surface are connected by a plane surface 154 inclined at an angle "θ" to the plane of end part 106, as best seen in FIG. 3. Furthermore, a groove preferably of triangular cross-section defined by an angled plane surface 156 intersecting another plane surface 158 is formed in lower part 104, with surface 156 inclined oppositely to surface 154 and making an angle "θ" to surface 158 which is perpendicular to the planar portion of lower part 104. This is best understood with reference to FIG. 3.

The structure just described ensures that there are two angled cooperating faces 154 and 156 which respectively fit to surfaces 2154 and 2156 of male connector 2100 when female connector 100 is operatively fitted thereto. This is best understood by reference to FIGS. 3 and 21. Note that this is another application of the principle of using inclined surfaces of the male and female connectors to facilitate convenient simultaneous engagement of numerous pins of the male connector with correspondingly disposed pin receptacles of the female connector, as described below in greater detail.

First and second locating projections 151 and 153 may also be provided outside tapers 155, each making an angle "β" relative to the widthwise direction of the female connector body 100. This is best understood with reference to FIG. 4. Even further, the upper and lower corner portions of locating projections 151 and 153 may be faceted at an angle "α", as best seen in FIG. 2. Thus-faceted forwardmost portions of locating projections 151 and 153 readily and closely fit into correspondingly sized, shaped and located recesses 2151 and 2153, respectively, of the male connector 2100, as best understood with reference to FIG. 22.

As will be appreciated from reference to FIG. 21, if female connector 100 is to be fitted to male connector 2100, taking into account the various extensions and/or faceting surfaces discussed above, the outer peripheral shape and size of female connector 100 must be such as to be received closely into the front open space of male connector 2100. Furthermore, to effect the desired electrical connections, for each of the pins, i.e., data pins "D", jumper pins "J", and power pins "P" of the male connector 2100, there must be a correspondingly shaped, sized, and located electrically-conducting pin receptacle in female connector 100. As will be well understood, each of the pins "D", "J" and "P" of male connector 2100 will have its own correspondingly sized, shaped and located lead and wire (not shown) connected to selected elements of a circuit served thereby.

Each of the pin receptacles provided in female connector 100 has the form of an elongate element with an open front end, and is electrically insulated from each of the other pin receptacles. Each pin receptacle will also have a tail ending in a lead such as "DL" for data line leads, "JL" for jumper line leads, and "PL" for power line leads (best seen in FIGS. 4 and 6) extending outwardly of rear face 182.

The body of female connector 100 is preferably made of the same type of known strong, electrically insulating, durable, easily-formed and affordable plastics material as used to make the body of male connector 2100. Numerous such plastics are known, and the exact composition is not critical to the success of the present invention.

Thus, through the width of the body of female connector 100 extend a plurality of pin receptacles having open forward ends at front surface 180 (as best seen in FIGS. 1 and 5), and each having a lead extending outwardly of rear surface 182, (as best seen in FIGS. 4 and 6). Individual pin receptacles are made of metal and may be molded in place within the body of female connector 100 in any known manner during manufacture. The exact composition of the metal used to form such pin receptacles is not critical, and any known suitable metal and/or alloy may be utilized. The selected material should preferably be non-corrodible under normal operating conditions of ambient temperature, humidity and pollution.

The dimensions of the open end of each pin receptacle must be selected to ensure a convenient but effective electricity-transmitting contact when a corresponding pin of the male connector 2100 is fitted therein. The open forward portion of each pin receptacle may be provided with one or more lengthwise splits in a manner commonly utilized in such electrical connections. The exact details thereof are, therefore, considered to be well understood by persons of ordinary skill in the art and not critical to this invention.

Similarly, the various leads corresponding to each of the pin receptacles may be provided during manufacture with a coating or treatment deemed suitable for facilitating good electrical connection thereat of numerous corresponding wires. Again, the exact composition, size, shape, and manner of application of such treatments is not deemed critical to the present invention, and any known technology may be utilized.

The above may be summarized thus: female connector 100 is shaped and sized to be forcibly yet readibly fitted to a correspondingly shaped and sized male connector 2100 to effect simultaneous electrical connections between data pins "D" and data receptacles "DR", between jumper pins "J" and jumper receptacles "JR", and between power pins "P" and power pin receptacles "PR". There are, therefore, three distinct sets of pin receptacles "DR" having leads "DL", "JR" having leads "JL" and "PR" having leads "PL".

The above-described structure permits the provision of eight or nine pin receptacles "JR", i.e., optionally one more than previously available, a feat realized by eliminating a portion of what was the dividing wall 1950 in the prior art structure per FIGS. 19 and 20. A recess 144 is formed and is oriented in the upper planar part 102, as depicted in FIGS. 5, 6, 11 and 12. One of the pin-receptacles is located directly below the recess 144, as best seen in FIGS. 5 and 11. Note that this is facilitated also by removal of virtually all of divider element 1952 as well.

Reference to FIG. 22 shows that one of the data pins in the upper line, at a located identified by the numeral "2199" is shown missing. This is intended to be exemplary, and indicative of the fact that one or more such pins may be omitted as deemed appropriate. Correspondingly, as best understood with reference to FIG. 5, the corresponding pin receptacle 199 may also be omitted. These are merely examples and the precise locations of such omitted pins/pin receptacles is a matter of design choice.

Although the term jumper pins "J" and jumper pin receptacles "JR" has been employed in the above discussion, not every one of these pins/pin receptacles needs to serve the same function as all of the others in that set. In other words, some of these may be utilized to provide power at a selected voltage, others may be utilized for data collection, and yet others may be utilized for diagnostic lines. The present invention is intended to provide an ample supply of pins/pin receptacles to add flexibility to existing systems, i.e., to provide backward capability so that a user may utilize the optimum power supply voltage, have the flexibility to perform diagnostics and to utilize a large number of data lines simultaneously with new and/or existing IDE systems.

The above-described first embodiment of the present invention permits simultaneous total engagement between all the pins of a male connector 2100 and pin-receptacles of a female connector 100 to effect operative engagement of all data, jumper and power lines. There are, however, other applications in which it may be desirable to provide a female connector which engages with only a portion of a male connector 2100. The following description relates to two such embodiments which engage with correspondingly different portions of male connector 2100.

A second preferred embodiment is illustrated in FIGS. 7-12. As will be readily apparent, the only structural difference between the first preferred embodiment 100 per FIGS. 1–6 and the second preferred embodiment 700 per FIGS. 7–12 is that the latter totally lacks that portion which accommodated the four power pin receptacles "PR". Female connector 700 is, therefore, shorter in length than female connector 100. The end part 106 which previously was furthest away from end part 108 of the peripheral surface continues to remain so, except that it has now moved to be at the far end of the junction pin receptacles "JR". Other than this and obvious related incidental distinctions among the various views, there are no other structural distinctions that need to be described in detail. The female connector 100, as noted above, permits simultaneous engagement of all of data pins "D", jumper pins "J" and power pins "P" of male connector 2100. Female connector 700, on the other hand, permits simultaneous engagement only of data pins "D" and jumper pins "J".

A third preferred embodiment 1300 is illustrated in FIGS. 13–18, and differs from the second preferred embodiment per FIGS. 7–12 in that it lacks only the portion which accommodated junction pin receptacles "JR". The end part 106 (opposed to end part 108 of the peripheral surface) is now moved to be immediately adjacent to and contiguous with the outside portions of locating element 151. Other than that, the structural features, aspects and utilization of female connector 1300 are as described correspondingly in the preceding discussion of the first preferred embodiment per FIGS. 1–6.

Although the present invention has been described and illustrated in detail, it should be clearly understood that the same is by way of illustration and example only and is not to be taken by way of limitation, the spirit and scope of the present invention being limited only by the terms of the appended claims.

What is claimed is:

1. A female connector for mating with a portion of an elongate 3-in-1 IDE interface and power male connector, to selectively engage therewith to connect to data transfer lines via a set of data transfer pins of the male connector, comprising:

an elongate generally cubical body of a first length, a first width, and a first height, the body having a front face and a rear face and a peripheral surface comprising a planar upper part, a discontinuously planar base part, and first and second end parts;

a fitting portion projecting outwardly of the base part and oriented in a width-wise direction;

first and second locating projections extending outwardly of the front face; and a set of open-ended pin-receptacles, mounted in and extending through the body in a width-wise direction thereof so that each pin-receptacle is arrayed to receive through the front face of the body a respective data transfer pin of the male connector.

2. The female connector according to claim 1, wherein:

the fitting portion extends the first width, has an outer planar face, and has a tapered front portion adjacent the front face of the body.

3. The female connector according to claim 1, wherein:

the first and second locating projections each have a tapered distal end portion, with the first locating projection located immediately adjacent the first end part and the second locating projection located immediately adjacent the second end part.

4. The female connector according to claim 1, wherein:

the pin-receptacles are arranged in two parallel lines, and have respective open ends formed and located to simultaneously receive and closely fit to respective data pins of the male connector.

5. The female connector according to claim 3, wherein:

the fitting portion extends the first width, has an outer planar face, and has a tapered front portion adjacent the front face of the body.

6. The female connector according to claim 5, wherein:

the pin-receptacles are arranged in two parallel lines, and have respective open ends formed and located to simultaneously receive and closely fit to respective data pins of the male connector.

7. A female connector for mating with a portion of an elongate male 3-in-1 IDE interface and power connector, to selectively engage therewith to provide electrical power at a selected voltage and connect to data transfer lines via respective first and second sets of pins of the male connector, comprising:

an elongate generally cubical body of a first length, a first width, and a first height, the body having a front face and a rear face and a peripheral surface comprising a planar upper part, a discontinuously planar base part, and first and second end parts;

first and second sets of open-ended pin-receptacles, mounted in and extending through the body in a width-wise direction thereof so that each set of pin-receptacles is arrayed to receive through the front face of the body a respective set of correspondingly arrayed pins of the male connector, and a recess oriented along the first width formed into the planar upper part;

wherein the first set includes a number n of the pin-receptacles arrayed to one side of the recess and a number n+1 pin-receptacles arrayed parallel in the n pin receptacles in such a manner that one of the n+1 pin receptacles is located directly beneath the recess.

8. The female connector according to claim 7, wherein n equals 4.

9. The female connector according to claim 8, further comprising a fitting portion projecting outwardly of the base part and oriented in a width-wise direction, and first and second locating projections extending outwardly of the front face.

10. The female connector according to claim 9, wherein:

the fitting portion extends the first width, has an outer planar face, and has a tapered front portion adjacent the front face of the body.

11. The female connector according to claim 9, wherein:

the first and second locating projections each have a tapered distal end portion, with the first locating projection located immediately adjacent the first end part of the peripheral surface and the second locating projection located intermediate the first and second end parts.

12. The female connector according to claim 9, wherein:

the second set comprises pin-receptacles arranged in two parallel lines and having respective open ends formed and located to simultaneously receive and closely fit to respective data transfer pins of the male connector.

13. The female connector according to claim 9, wherein the first set includes pin-receptacles for providing electrical power at said selected voltage and the second set includes pin-receptacles for connecting to respective data transfer lines, each pin-receptacle having a lead end projecting from the rear face of the body.

14. A female connector for mating with a male 3-in-1 IDE interface and power connector, to engage therewith to provide electrical power selectively at first, second and third voltages via respective first, second and third sets of pins of the male connector, comprising:

an elongate generally cubical body of a first length, a first width, and a first height, the body having a front face and a rear face and a peripheral surface comprising a planar upper part, a discontinuously planar base part, first and second end parts, and a first angled face which intersects the second end part and the base part and is inclined at a first angle to the base part;

first, second and third sets of open-ended pin-receptacles, mounted in and extending through the body in a width-wise direction thereof so that each set of the pin-receptacles is arrayed to receive through the front face of the body a respective set of correspondingly arrayed pins of the male, connector, and;

a recess oriented along the first width formed into the planar upper part adjacent the third set;

wherein the first includes pin-receptacles for providing electrical power at said first and second voltages and the second set includes pin-receptacles for providing power at said third voltage, each pin-receptacle having a lead end projecting from the rear face of the body;

and wherein the second set includes a number n of the pin-receptacles arrayed to one side of the recess and a number n+1 pin-receptacles arrayed parallel to the pin-receptacles in such a manner that one of the n+1 receptacles is located directly beneath the recess.

15. The female connector according to claim 14, wherein:

the groove is located between the first and second sets and extends the first width of the body.

16. The female connector according to claim 14 wherein:

the fitting projection extends the first width, has an outer planar face, and has a tapered front portion adjacent the front face of the body.

17. The female connector according to claim 14, wherein:

the first and second locating projections each have a tapered distal end portion, with the first locating projection located immediately adjacent the first end part of the peripheral surface and the second locating projection located intermediate the first and second end parts.

18. The female connector according to claim 14, wherein:

the first set comprises four pin receptacles and is located between the first and second angled surfaces.

19. The female connector according to claim 18, wherein:

the first set comprises a first pair of pin-receptacles for connecting to a 12.0 V power supply and a second pair of pin-receptacles for connecting to a 5.0 V power supply.

20. The female connector according to claim 14, wherein:

the third set comprises pin-receptacles arranged in two parallel lines and having respective open ends formed and located to simultaneously receive and closely fit to respective data transfer pins of the male connector.

21. The female connector according to claim 14, wherein:

the groove is located between the first and second sets and extends the first width of the body;

the fitting projection extends the first width, has an outer planar face, and has a tapered front portion adjacent the front face of the body;

the first and second locating projection each have a tapered distal end portion, with the first locating projection located immediately adjacent the first end part of the peripheral surface and the second locating projection located intermediate the first and second end parts; and the first set is located between the first and second angled surfaces, and comprises a first pair of pin-receptacles for connecting to a 12.0 V power supply and a second pair of pin-receptacles for connecting to a 5.0 V power supply.

22. The female connector according to claim 14, further comprising:

a groove formed in the base part, having a cross-section partially defined by a second angled surface inclined at a second angle to the base part;

a fitting portion projecting outwardly of the base part and oriented in a width-wise direction; and first and second locating projections extending outwardly of the front face.

23. The female connector according to claim 14, wherein n equals 4.

* * * * *